US006705882B2

(12) United States Patent
Casses

(10) Patent No.: US 6,705,882 B2
(45) Date of Patent: Mar. 16, 2004

(54) CONNECTOR WITH A MATING ASSISTANCE DEVICE

(75) Inventor: Claude Casses, Clevilliers (FR)

(73) Assignee: FCI, Paris (FR)

( * ) Notice: Subject to any disclaimer, the term of this patent is extended or adjusted under 35 U.S.C. 154(b) by 0 days.

(21) Appl. No.: 10/252,970

(22) Filed: Sep. 23, 2002

(65) Prior Publication Data

US 2003/0068910 A1 Apr. 10, 2003

(30) Foreign Application Priority Data

Sep. 24, 2001 (FR) ..... 01 12567

(51) Int. Cl.[7] ..... H01R 13/62

(52) U.S. Cl. ..... 439/157; 439/153; 439/158; 439/160; 439/372

(58) Field of Search ..... 439/157, 372, 439/322, 153–160, 754, 762, 763, 764, 801; 429/121

(56) References Cited

U.S. PATENT DOCUMENTS 4,900,261 A * 2/1990 Gentry et al.
5,616,433 A * 4/1997 Kau
5,658,162 A * 8/1997 Harting et al. ..... 439/372
5,964,604 A 10/1999 Kashiyama et al. ..... 439/157
2003/0003787 A1 * 1/2003 Bakker et al. ..... 439/157

FOREIGN PATENT DOCUMENTS

| | | |
|---|---|---|
| DE | 8714016.0 | 1/1988 |
| EP | 0273999 A2 | 7/1988 |
| EP | 1037326 A2 | 9/2000 |

* cited by examiner

*Primary Examiner*—Dean A. Reichard
*Assistant Examiner*—Nguyen T. Ha
(74) *Attorney, Agent, or Firm*—Perman & Green, LLP

(57) ABSTRACT

A connector having a first module (1) carrying a lever (2) provided with at least one maneuvering arm (3), and a second module (4) provided with at least one stud (5). The lever (2) is provided with at least one stud reception aperture. The aperture has a stud introduction segment (7) and a stud stopping segment (8). The stopping segment (8) constitutes together with the stud (5) of the second module, an axis of rotation of the lever.

9 Claims, 3 Drawing Sheets

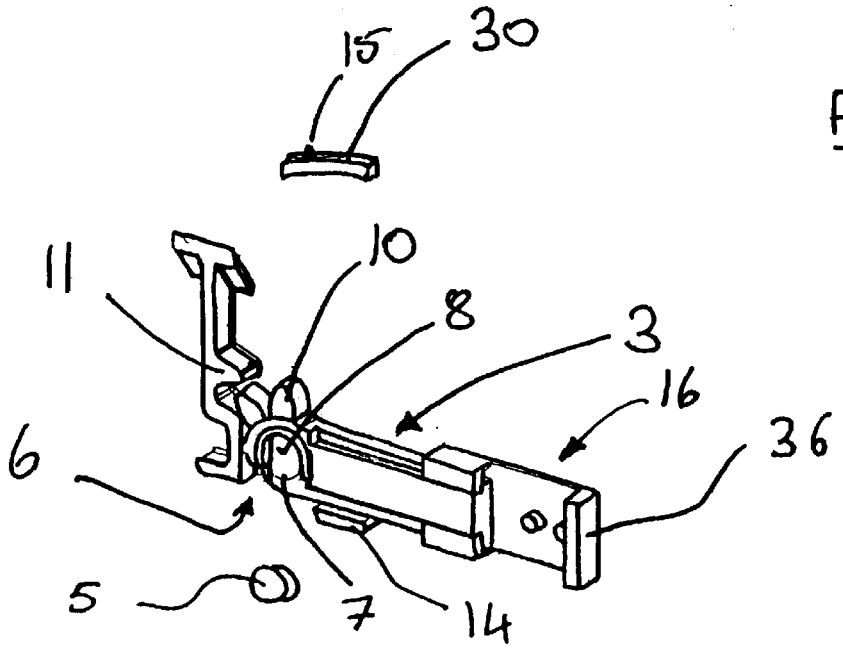
Fig. 4a.
Fig. 4b.
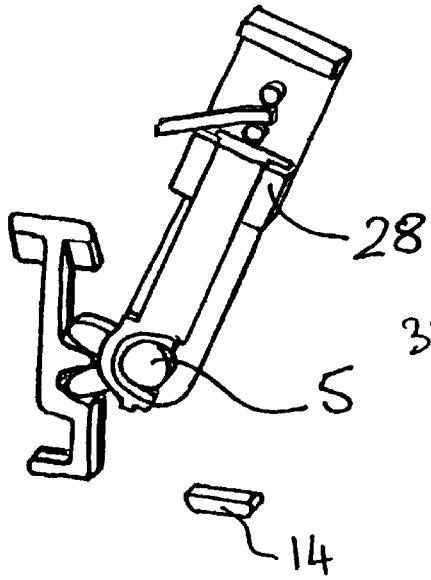
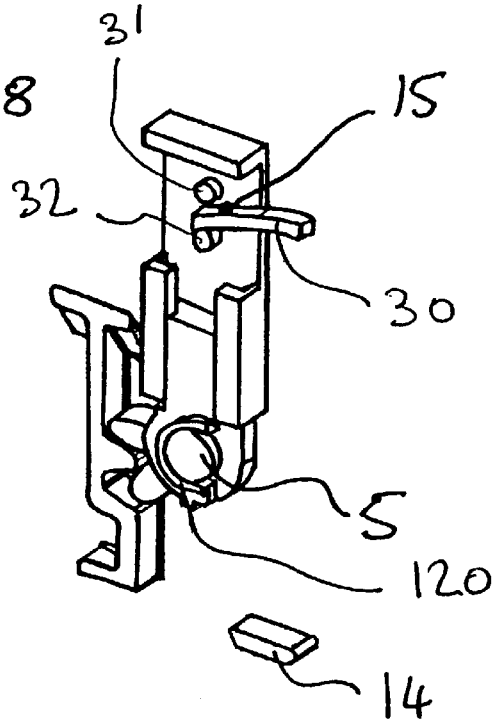
Fig. 4c.

CONNECTOR WITH A MATING ASSISTANCE DEVICE

BACKGROUND OF THE INVENTION

1. Field of the Invention

The invention relates to an electrical connector provided with a mating assistance device. Such connectors are used, in particular, for connecting an electrical harness which contains a large number of channels, to a piece of equipment such as an automotive computer, for example a computer which controls braking assistance devices and anti-wheel lock devices. Because of the large number of channels to be connected, such connectors comprise a large number of contacts, which make it necessary to exert a large amount of force to implement their mating. Such connectors comprise a plug, generally provided with female contacts to which are connected electrical cables and include a receptacle provided with pin contacts, the said receptacle generally being integral with the equipment to be connected.

2. Brief Description of Related Developments

Connector devices comprising a mating assistance device are known.

For example, document DE-U-87 14 016 relates to a plug-receptacle connector, where the plug is provided with a lever able to rotate about the axis of the plug, provided with a toothed part and with arms connected by a manoeuvring segment, the toothed part being destined to mesh with the supplementary teeth of the receptacle in such a way as to make possible the mating and unmating of the plug and the receptacle by means of the manoeuvring of the lever.

Document EP 0 273 999 A2 uses the principle of toothed lever, but this is arranged on the receptacle, rigidly connected to the receptacle by an axis of rotation and dragging a stirrup provided with reception and dragging ramps for dragging the studs arranged on the plug.

SUMMARY OF THE INVENTION

The present invention has the object of providing a connector comprising a sophisticated rotating device for mating assistance for an electrical connector, the said device providing better guidance of the plug and the receptacle during the process of mating and a better distribution of effort and pure rotation of the lever, as well as providing a large reduction of the efforts needed for the mating of the connector modules.

To accomplish this, the invention mainly relates to a connector comprising a first module carrying a lever, provided with at least one manoeuvring arm, a second module provided with at least one stud, the lever being provided with at least one stud reception aperture, the said aperture comprising a stud introduction segment and a stud stopping segment, the stud stopping segment constituting, together with the stud of the second module, an axis of rotation of the lever.

Advantageously, the lever and the first module comprise a supplementary means of dragging the first module by moving it in a direction parallel to a mating axis of the first and second modules.

The supplementary means of dragging can consist of a meshing toothed pinion on the lever and a rack bar on the first module.

More particularly, the lever can be received in a slide bar part, making possible a movement with respect to the lever and the first module in a direction parallel to the module mating axis and retaining the lever in an axis perpendicular to that direction.

According to a first embodiment of the invention, the lever and the first module can comprise supplementary means of temporary retention in a position called the stud reception position.

Still in accordance with the invention, the lever and the first module can comprise a means of locking into a position called end of mating.

In a particular mode of embodiment of the invention, the lever can comprise a telescopic manoeuvring component.

In a preferred mode of embodiment, the lever is a double lever, arranged to straddle the first module and comprising two apertures opposite one another, the second module comprising two studs arranged against one another in the same axis.

BRIEF DESCRIPTION OF THE DRAWINGS

The invention will be better understood on reading the description which follows of a non-limitative embodiment example and referring to diagrams where

FIGS. 4*a* to 4*c* are schematic views of the kinematic of a manoeuvring device according to an embodiment of the invention.

DETAILED DESCRIPTION OF THE PREFERRED EMBODIMENT

Figure 1:
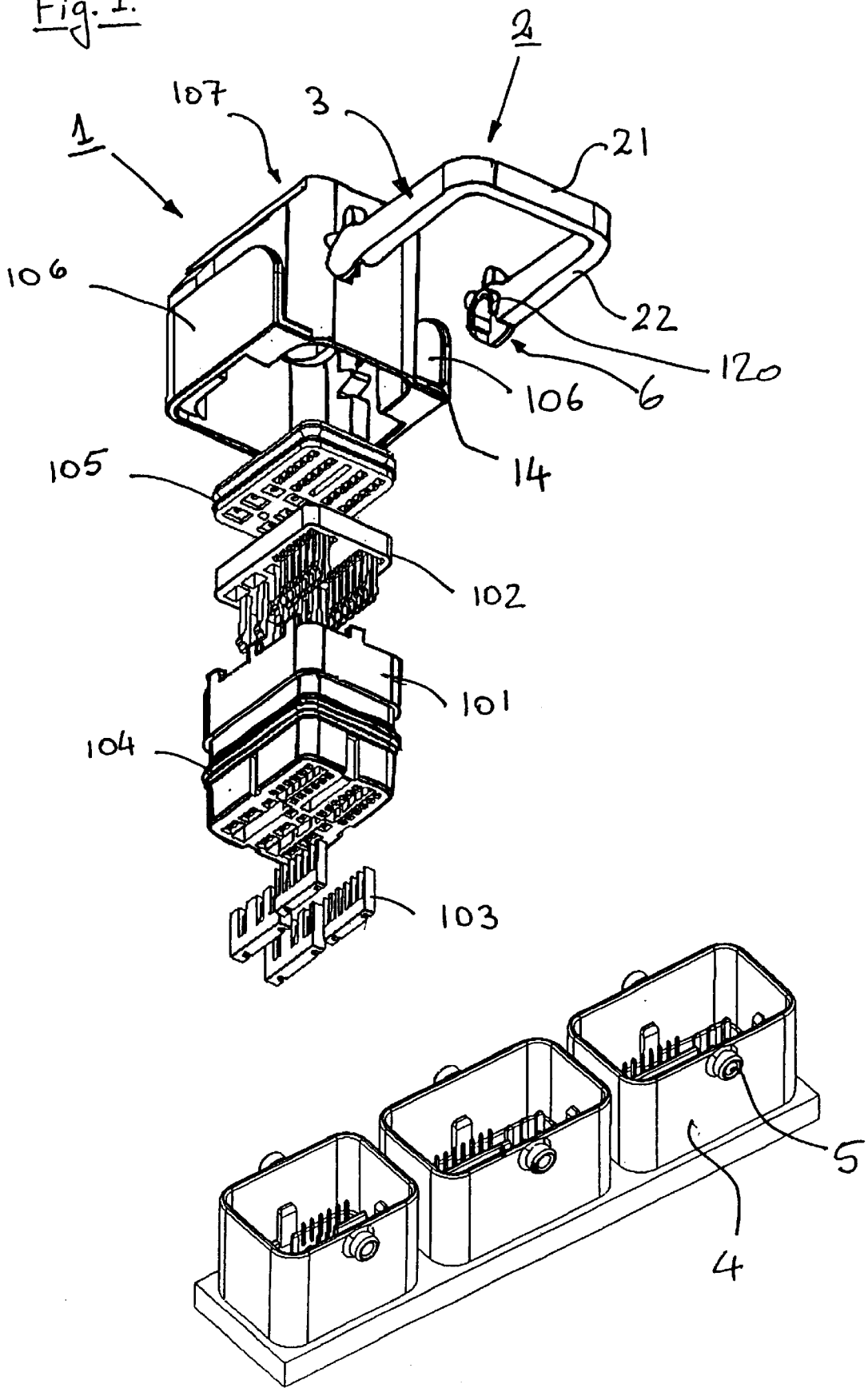
FIG. 1 is an exploded perspective view of a plug and receptacle connector according to the invention, before mating.

As can be seen FIG. 1 and according to the example under consideration, the connector comprises a first module 1 and a second module 4. These connector modules have a supplementary engagement profile and receive contact elements and/or optical plugs. The contacts of the first module are, for example, strapped to cables emerging from a back part 20 of module 1, the complementary contacts of the second module being able to be connected to a printed circuit or strapped to the cables. Module 1 consists of an envelope 100, which receives a contact carrier 101 which may be provided with a primary contact locking device 102 and a secondary locking device 103 of these contacts. In the case of a sealed connector module, an assembly of joints 104 and 105 can be provided. The different elements constituting the module are assembled and the contacts are then inserted through a back wall 107 of the envelope 100, A cover 110 can close the back of the first module, leaving a passage for the cables strapped to the contacts.

The first module 1 carries the rotating lever 2. This lever makes it possible to effect the mating of the modules and is in the example shown of a double lever arranged to straddle the first module 1, comprising two manoeuvring arms 3, 22, strapped by a central strap 21 and comprising at their free end an actuating part provided with means which make possible an engagement with the second module and a traction of the first module towards the second module. The lever arms are received each in a seating comprising the walls 106, which protect an actuating device, which will be described below.

The lever, which is always visible FIG. 1 comprises two arms 3, 22 connected by a central strap 21. On one side of the arm 3 is located the central strap 21. At the other end is the actuating part. This actuating part has the shape of a disc, whose at least one peripheral sector comprises a toothed pinion, the disc comprising on its face opposite the first module a aperture 6 comprising a rectilinear segment 7 open laterally on a section of the periphery of the disc and a semicircular profile segment 8 concentric with the toothed pinion.

The actuating part of the lever is received pressing against a slide bar wall 12 of the first module 1, this slide bar wall enabling a movement with respect to lever 2 and the first module 1 in a direction parallel to the mating axis of the modules and retaining the lever in an axis perpendicular to that direction. The lever is guided in this slide bar and is able to turn.

The slide bar comprises two pillars parallel to the direction of mating of the modules. One of the pillars consisting of the slide bar wall 12 comprises a smooth profile against which the disc can support itself while the other pillar comprises a rack bar 11, destined to be engaged by the teeth of the toothed pinion 10 carried by the disc. The guiding of the lever being performed by the support of a shroud 120 against the slide bar wall 12.

The functioning of the mating assistance device will be described below.

The lever is first inserted onto the slide bar up to a pre-engagement position of the teeth in the rack bar 11. The insertion of the lever is made possible by elastic deformation of the walls or flanges 106 as far as the end parts of the lever straps taking their place in the slide bars. It should be noted that the guidance elements such as the studs 13 can be provided, in cooperation with the sides 14 connecting the flanges 106 with the body of the first module, for guiding the lever when it is inserted.

In the inserted position, the lever has an angular orientation such that the opening, which terminates segment 7 is positioned opposite stud 5 of the second module 4, when the first module is presented in the pre-insertion position with the second module. By pushing the first module into the second module, the stud enters into segment 7 until it arrives at the stopping segment 8.

At that moment, it is possible to turn the lever, the stud 5 constituting in the stopping segment 8 an axis of rotation of the lever. The rotation of the lever takes place in a fixed axis of the second module, the teeth of the pinion pressing on the teeth of the rack bar which forces the insertion of the first module into the second module. For its part, the lever is only subject to a rotation movement with respect to the second module and thus remains in arc of a circle with respect to the second module. The relative positions of the lever and the modules before mating can be seen in FIG. 2, FIG. 3 for its part showing the mated connectors and the lever in the end of course position. To be able the better to distinguish the engagement device, the flanges 106 in FIG. 2 and 3 have been cut away.

Thus, once the lever is inserted in the slide bar, a rotation of the lever becomes converted into a longitudinal movement of the lever in the slide bar, following the engagement of the teeth of the pinion in the rack bar 11. This system constitutes a supplementary means of dragging the first module in a direction parallel to a mating axis of the first and second modules.

The detailed functioning of actuating devices is visible FIGS. 4*a* to 4*c*, which show a section of a lever according to the invention, in three positions, the insertion of the first module into the second module, the rotation and locking. The section is in the plan view of the central strap of the lever and show the part of the supplementary rack bar of the first module and the stud of the first module inserted in it reception aperture.

Also visible, particularly FIGS. from 4*a* to 4*c*, supplementary means of temporary retention 13,14 in a position called the stud reception position, can advantageously be provided between the lever 2 and the first module 1. These means can consist of a simple dimple 13 on the envelope, the dimple against which the arm abuts. These means can also comprise elastic means of retention such as lug device received in a seating.

Figure 3:
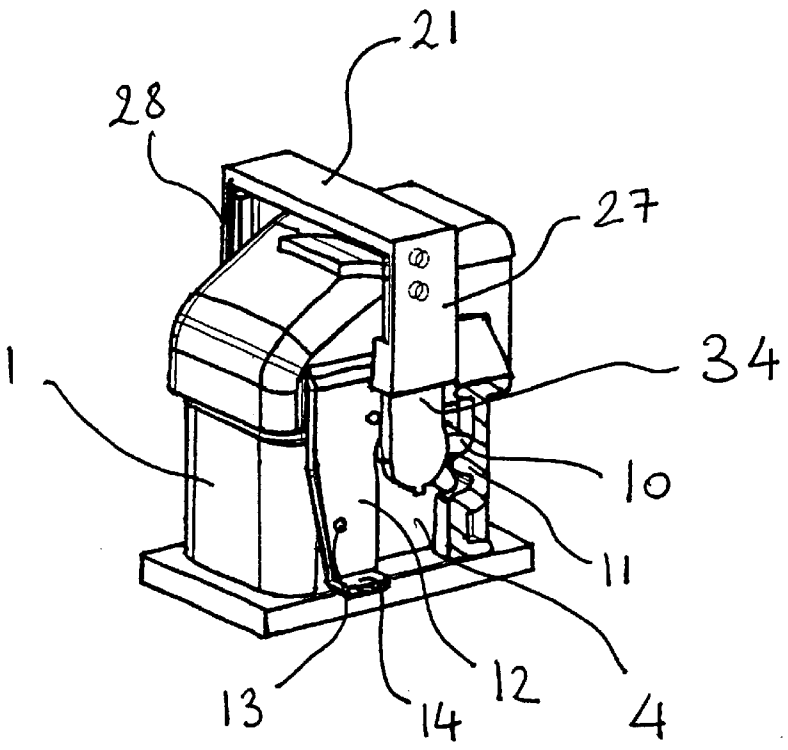
FIG. 3 is a perspective view of the mated connector from FIG. 2.
Figure 2:
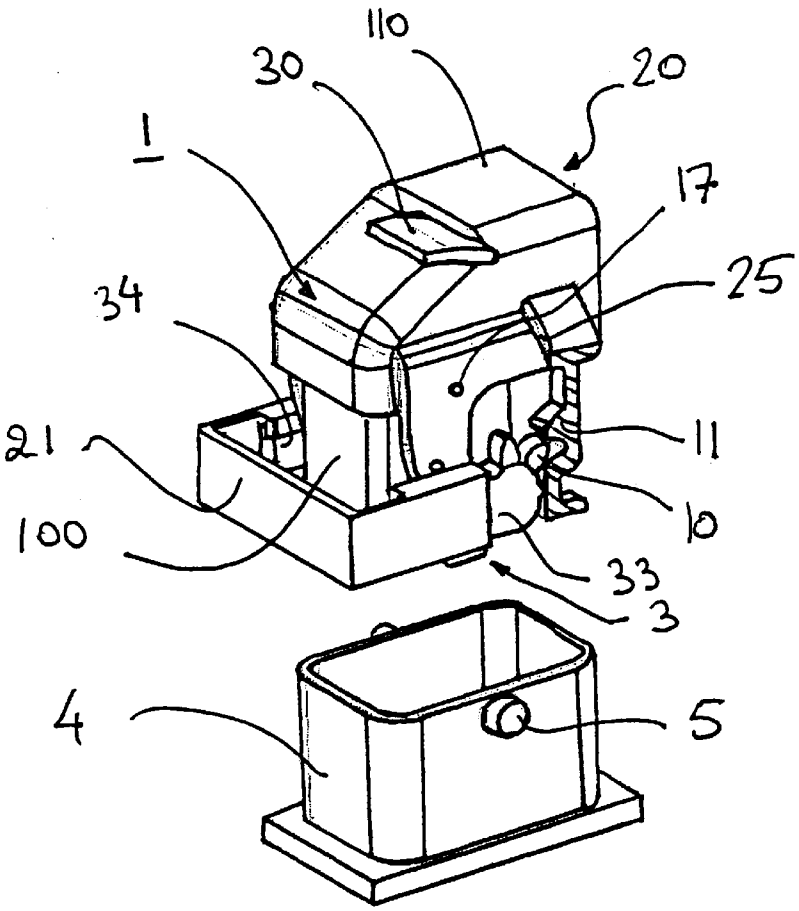
FIG. 2 is a perspective view of the connector from FIG. 1 before mating.

Similarly, the lever and the first module can comprise means of locking 15,17 in a position called end of mating. These means can be a dimple 15 located on a portion of a guide rail 30 of an arm element as described in FIG. 4 or can consist of a dimple 17, retaining the arm 3 at the end of course of the lever, as shown in FIGS. 2 and 3.

In a particular mode of embodiment shown FIGS. 4*a* to 4*c*, and FIGS. 2 and 3, the lever can comprise a telescopic manoeuvring element 16. This telescopic element makes it possible to increase the lever arms whilst preserving a small size of the connector. This telescopic element consists of arms 27,30, connected by a central strap 36, the arms being mounted on slide bars on arms 33,34 of two lever elements in this separate case.

The telescopic element of manoeuvre can be guided by a curved rail 30, for example on a cover 110 closing the back of the first module, a rail guiding the lever in its movement and controlling the extension and the retraction of the telescopic element in concert with the guidance studs 31,32.

The unlocking and unmating of the modules takes place by the reverse movement of the lever.

What is claimed is:

1. A connector comprising a first module carrying a lever with at least one manoeuvring arm, a second module provided with at least one stud characterised by the fact that the lever is provided with at least one aperture of stud reception, this aperture comprising a stud introduction segment and a stud stopping segment, the stopping segment constituting with the stud of the second module an axis of rotation of the lever.

2. A connector comprising a first module carrying a lever with at least one maneuvering arm, a second module provided with at least one stud characterised by the fact that the lever is provided with at least one aperture of stud reception, this aperture comprising a stud introduction segment and a stud stopping segment, the stopping segment constituting with the stud of the second module an axis of rotation of the lever, characterised by the fact that the lever and the first module comprise supplementary means of dragging the first module by transfer in a direction parallel to a mating axis of the first and second module.

3. A connector according to claim 2, characterised by the fact that the supplementary means of dragging comprise a meshing toothed pinion on the lever and a rack bar on the first module.

4. A connector according to claim 1, characterised by the fact that the lever is received in a slide bar making possible a movement with respect to the lever and the first module in a direction parallel to a module mating axis and retaining the lever in an axis perpendicular to that direction.

5. A connector according to claim 1, characterised by the fact that the lever and the first module comprise a means of temporary retention in a stud reception position.

6. A connector according to claim 1, characterised by the fact that the lever and the first module comprise means of locking in an end of mating position.

7. A connector comprising a first module carrying a lever with at least one maneuvering arm, a second module provided with at least one stud characterised by the fact that the lever is provided with at least one aperture of stud reception, this aperture comprising a stud introduction segment and a stud stopping segment, the stopping segment constituting with the stud of the second module an axis of rotation of the lever, characterised by the fact that the lever comprises a telescopic manoeuvring element, comprising, in turn, arm elements mounted on slide bars on the at least one manoeuvring arm.

8. A connector according to claim 7, characterised by the fact that the first module comprises a rail for guiding extension and retraction of the telescopic manoeuvring element.

9. A connector according to claim 1, characterised by the fact that the lever is a double lever arranged to straddle the first module, comprising two apertures opposite one another, the second module comprising two studs arranged against one another on the same axis.

* * * * *